US006216872B1

(12) United States Patent
Haasbroek

(10) Patent No.: US 6,216,872 B1
(45) Date of Patent: Apr. 17, 2001

(54) STACKABLE CONTAINER SUITABLE FOR TRANSPORTING PRODUCE

(75) Inventor: Albertus Jacobus Haasbroek, Glenstantia (ZA)

(73) Assignee: PQR 59 Properties (PTY) Ltd., Pretoria (ZA)

( * ) Notice: Subject to any disclaimer, the term of this patent is extended or adjusted under 35 U.S.C. 154(b) by 0 days.

(21) Appl. No.: 09/238,080

(22) Filed: Jan. 26, 1999

(30) Foreign Application Priority Data

Jan. 26, 1998 (ZA) ..... 98/0605

(51) Int. Cl.[7] ..... B65D 6/18
(52) U.S. Cl. ..... 206/512; 220/7; 220/4.34
(58) Field of Search ..... 220/6, 7, 4.28, 220/4.33, 4.34, 62, 326, 822, 826, 836, 840; 206/512, 511, 509

(56) References Cited

U.S. PATENT DOCUMENTS

| | | | | |
|---|---|---|---|---|
| 2,919,045 | * | 12/1959 | Waugh et al. | 220/4.34 |
| 3,119,508 | * | 1/1964 | Wallace | 220/6 |
| 3,246,828 | * | 4/1966 | Branscum | 220/6 |
| 4,014,458 | * | 3/1977 | Berges | 220/335 |
| 4,235,346 | * | 11/1980 | Liggett | 220/7 |
| 4,735,331 | * | 4/1988 | Keenan et al. | 220/6 |
| 4,789,075 | * | 12/1988 | Sun | 220/4.34 |
| 5,452,847 | * | 9/1995 | Harris et al. | 229/125.11 |
| 5,918,743 | * | 7/1999 | Uitz | 206/509 |
| 6,003,716 | * | 12/1999 | Allison et al. | 220/326 |

FOREIGN PATENT DOCUMENTS

| | | |
|---|---|---|
| 0 301 140 | 2/1989 | (EP) . |
| 0 659 650 | 6/1995 | (EP) . |
| 2 009 689 | 2/1970 | (FR) . |
| 2 506 723 | 12/1982 | (FR) . |
| 969707 | 11/1996 | (ZA) . |

* cited by examiner

*Primary Examiner*—Stephen Castellano
(74) *Attorney, Agent, or Firm*—Pennie & Edmonds LLP

(57) ABSTRACT

This invention provides a stackable collapsible container 10 comprising a housing 11 which is constituted by side walls 12; end walls 14; cover panels 16; and a floor panel 18. The container 10 further includes four load bearing shafts 24 for connecting the side and end walls 12 and 14 to each other and for supporting the weight of the load bearing shafts of another superjacent like container, when the containers are stacked. The load bearing shafts 24 support the weight of superjacent containers and not the containers themselves, and the housing portion of the container 10 may therefore be manufactured from a relatively thin light plastics material.

3 Claims, 10 Drawing Sheets

STACKABLE CONTAINER SUITABLE FOR TRANSPORTING PRODUCE

This invention relates to a stackable container suitable for transporting produce.

Many different kinds of stackable containers for transporting produce are known. Examples of these are re-usable non-collapsible crates of a plastics material and disposable collapsible cardboard boxes.

Crates of this type are relatively expensive and bulky and thus present the disadvantage of occupying considerable space, especially when empty and, because the crates are non-collapsible, it is relatively expensive to transport the empty crates.

A disadvantage of cardboard boxes is that they tend to get wet when stored in cold rooms and once they are wet, they collapse relatively easily, especially when stacked.

Collapsible stackable plastics containers have been used in the past to attempt to overcome the above disadvantages. One of the disadvantages of the previously proposed containers is that, in order to be stackable, a substantial amount of plastic material is used per container, thus making the containers relatively expensive. Another disadvantage of these containers is that the mechanism employed to make the containers collapsible, is relatively complicated.

South African patent number 96/9707 discloses a collapsible container assembly which includes a number of side walls and a floor adapted to be joined to the side walls to form a crate. The container assembly further includes connection means having complementary gaps and protrusions provided in the protrusions, the apertures at each pair of side meeting edges being in alignment. The container assembly further includes an elongate locking member of a plastics material, for each pair of side meeting edges of the side walls. The locking members are adapted to be inserted into the respective aligned apertures in the protrusions to releasably hold the protrusions of side meeting edges of the side walls together.

A disadvantage of this type of container assembly is that the locking members as such are not designed to bear the weight of a superjacent container when two like containers are stacked. An additional amount of plastics material therefore is incorporated into the side meeting edges of the side walls. Due to the additional plastics material, the cost of such containers is therefore usually relatively high. This type of container is therefore more suitable for use as a relatively large reusable pallet-type crate. Furthermore, with the locking member in position, the side members cannot pivot relative to each other. Therefore, in order to store and transport the container, the locking members have to be removed and the individual components of the container stacked.

SUMMARY OF THE INVENTION

Accordingly, the present invention provides a stackable container for produce, with which the aforesaid disadvantages may be overcome or at least minimised.

The stackable container of the invention is suitable for transporting produce and comprising a housing constituted by a first pair of opposed side walls, a second pair of opposed end walls, and a floor panel; and a plurality of separate elongate load bearing shafts connected to the housing and adapted to bear the weight of a superjacent container when two like containers are stacked.

The walls may each have two opposite side meeting edges, with one of the side meeting edges of one wall being connected to one of the side meeting edges of an adjacent wall by one of said load bearing shafts.

The side meeting edges of the walls may be provided with connecting means, with each connecting means comprising a plurality of staggered connecting formations for intermeshing with the staggered connecting formations of one of the other walls.

Each connecting formation may define an opening which is aligned with the openings of other connecting formations, for respectively receiving the load bearing shafts.

The side and end walls may be hinged to the floor panel.

The stackable container may include a cover member which is hinged to one of the walls.

Further according to the invention the housing is moulded in the form of a unitary blank from a plastic material and the walls and cover member are hinged by a plastic type hinge.

The blank may be stackable with other like blanks.

The housing may be provided with a retaining formation for retaining the cover member in a closed position.

Further according to the invention, the load bearing shaft comprises a metal rod having a head at one end defining a socket for receiving an opposite end of a load bearing shaft of a subjacent like container.

According to an alternative configuration of the invention, the first pair of opposed side walls and the second pair of opposed end walls forms a rectangular structure; the side walls being hinged together at their respective side meeting edges; and the rectangular structure formed by the side and end walls being removably connected to the floor panel and being collapsible when removed from the floor panel.

The walls may be hinged together by hinge formations, with each hinge formation comprising a plurality of staggered hinge members for intermeshing with the staggered hinge members of one of the other walls.

Each hinge member may define a bore which is aligned with the bores of other hinge members, for respectively receiving the load bearing shafts.

The stackable container may include an annular cover member which defines an opening and which connects to the rectangular structure in clip-on fashion.

The stackable container may further include a flexible web for closing the opening of the cover member, the web being trapped between the cover member and the rectangular structure, in use.

The floor panel may also connect to the rectangular structure in clip-on fashion.

The floor panel may also be annular to define an opening which is also closable by a flexible web which is trapped between the floor panel and the rectangular structure, in use.

The walls and floor panel may be performed and more particularly may define elongate slots to reduce the weight of each wall and the floor panel.

The end walls may each define a grip formation for handling of the container.

According to another alternative configuration of the invention, the first pair of opposed side walls and the second pair of opposed end walls forms a rectangular structure and the container includes a separate removable annular cover member defining an opening and which cover member is connectable to the rectangular structure in clip-on fashion, the cover member being adapted for trapping a flexible web between the cover member and the rectangular structure, to close the opening of the cover member.

BRIEF DESCRIPTION OF THE DRAWINGS

The invention will now be described further, by way of example only, with reference to the accompanying drawings wherein.

DESCRIPTION OF PREFERRED EMBODIMENTS OF THE INVENTION

Figure 1:
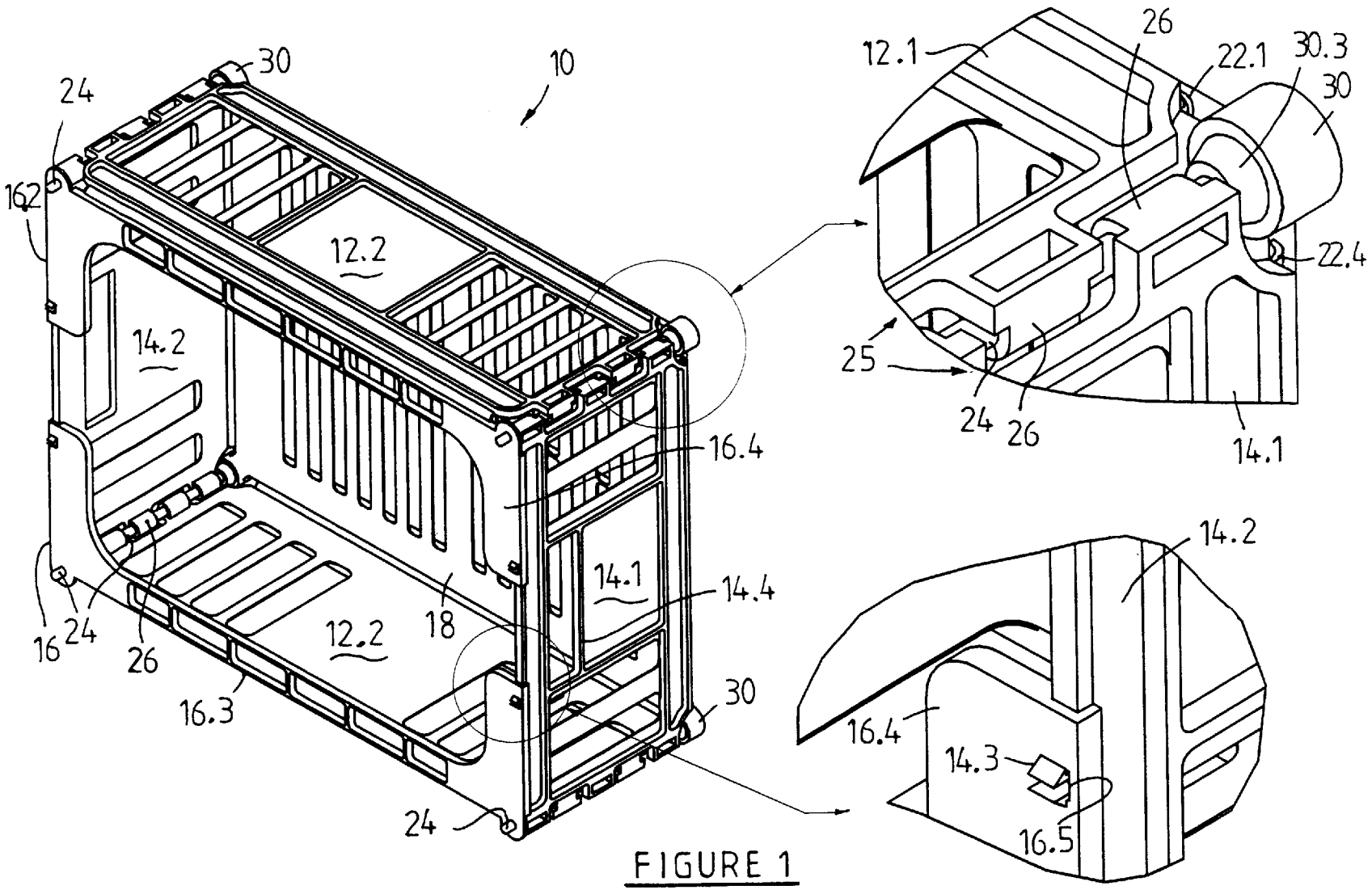
FIG. 1 is an assembled perspective view from above of a stackable collapsible container according to a first embodiment of the invention.

Referring to FIG. 1, a stackable collapsible container according to a first embodiment of the invention, of a plastics material and suitable for transporting produce such as fruit and vegetables, is generally designated by reference numeral 10.

The container 10 comprises a housing 11 (FIG. 4) which is constituted by a first pair of opposed side walls 12.1 and 12.2; a second pair of opposed end walls 14.1 and 14.2; a third pair of cover members or panels 16.1 and 16.2; and a floor panel 18.

Figure 2:
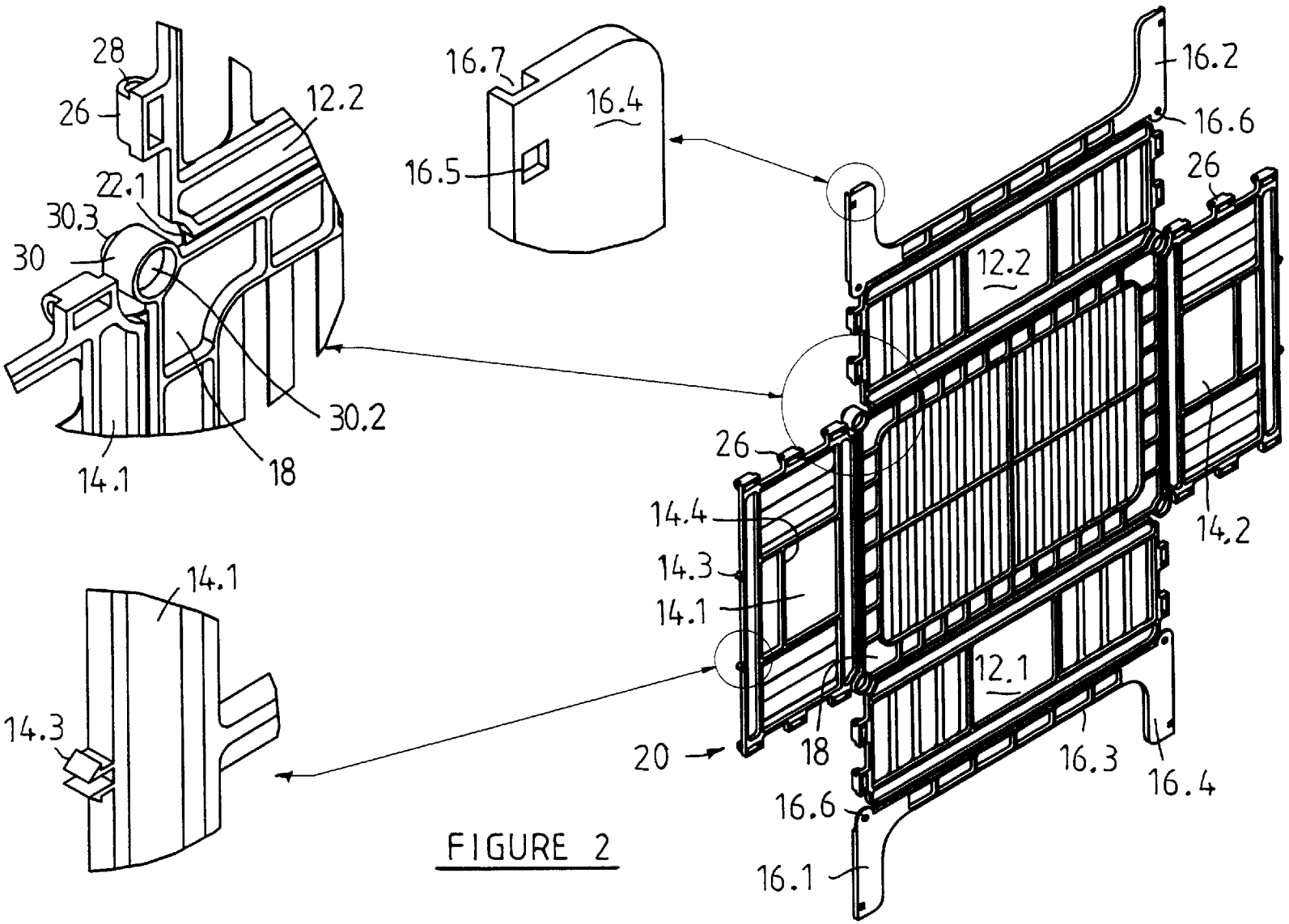
FIG. 2 is a perspective view from below of a blank for forming a housing of the stackable collapsible container of FIG. 1.
Figure 3:
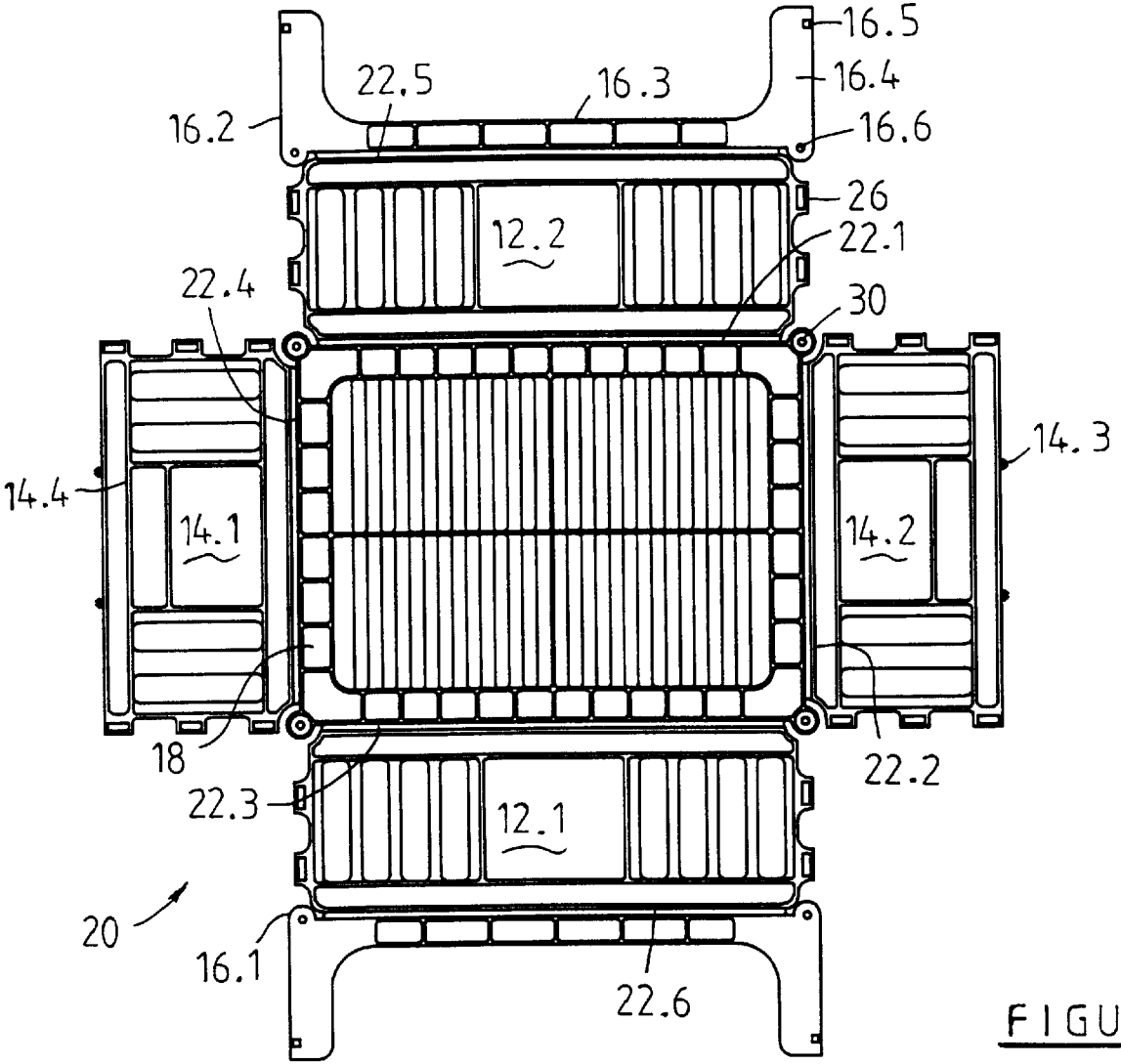
FIG. 3 is a view from below of the blank of FIG. 2.

Referring to FIGS. 2 and 3, the housing is made from polypropylene through an injection moulding process and is supplied in the form of a unitary, collapsed, relatively flat, stackable blank 20. The side walls 12 and end walls 14 are hinged to the edges of the floor panel 18 by plastic type hinges 22.1 to 22.4 (FIG. 3) and the cover panels 16 are respectively hinged to the side walls 12.1 and 12.2, also by plastic hinges 22.5 and 22.6 (also FIG. 3).

Figure 4:
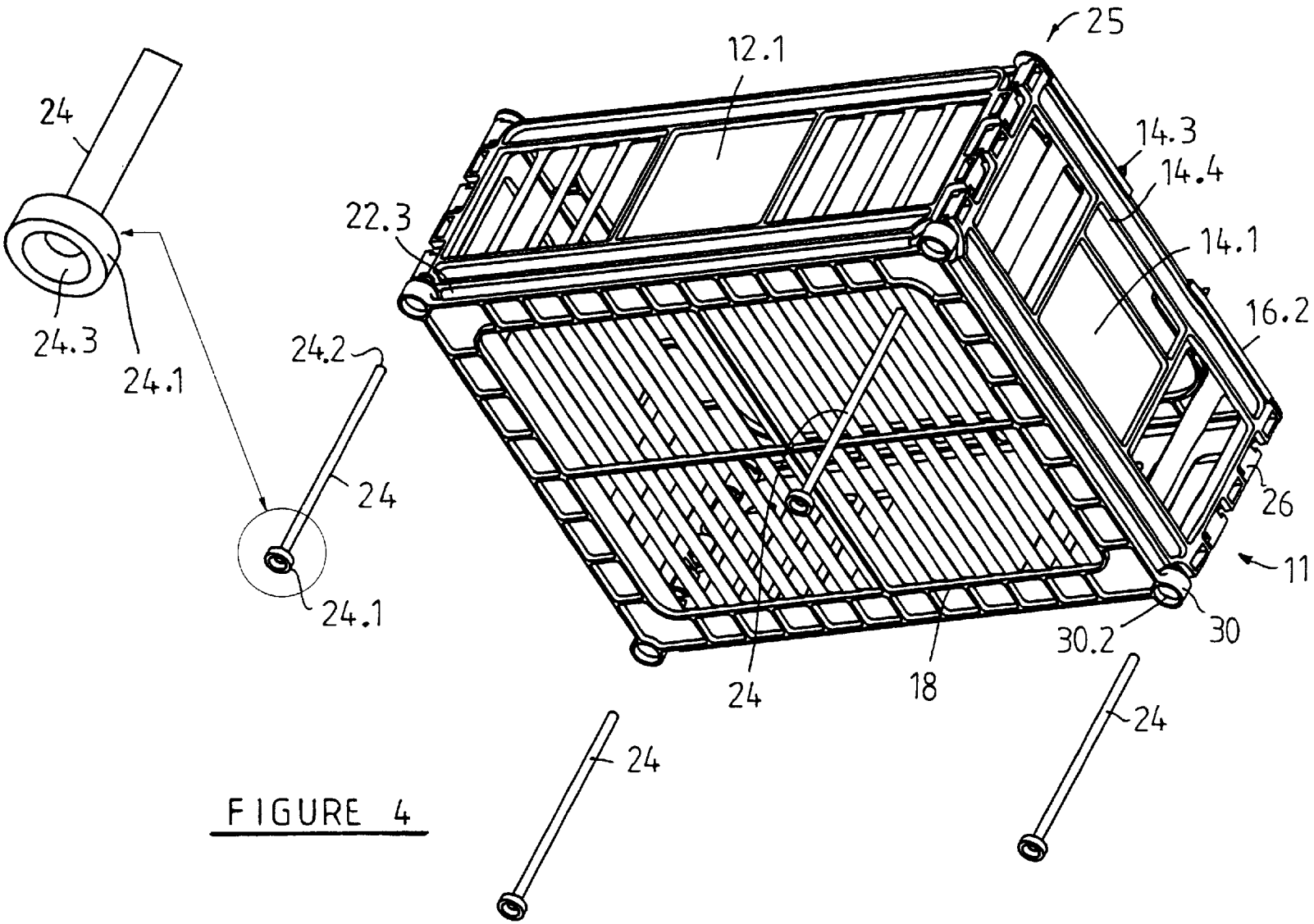
FIG. 4 is a perspective view from below of the container of FIG. 1, showing elongate load bearing shafts in exploded view.
Figure 5:
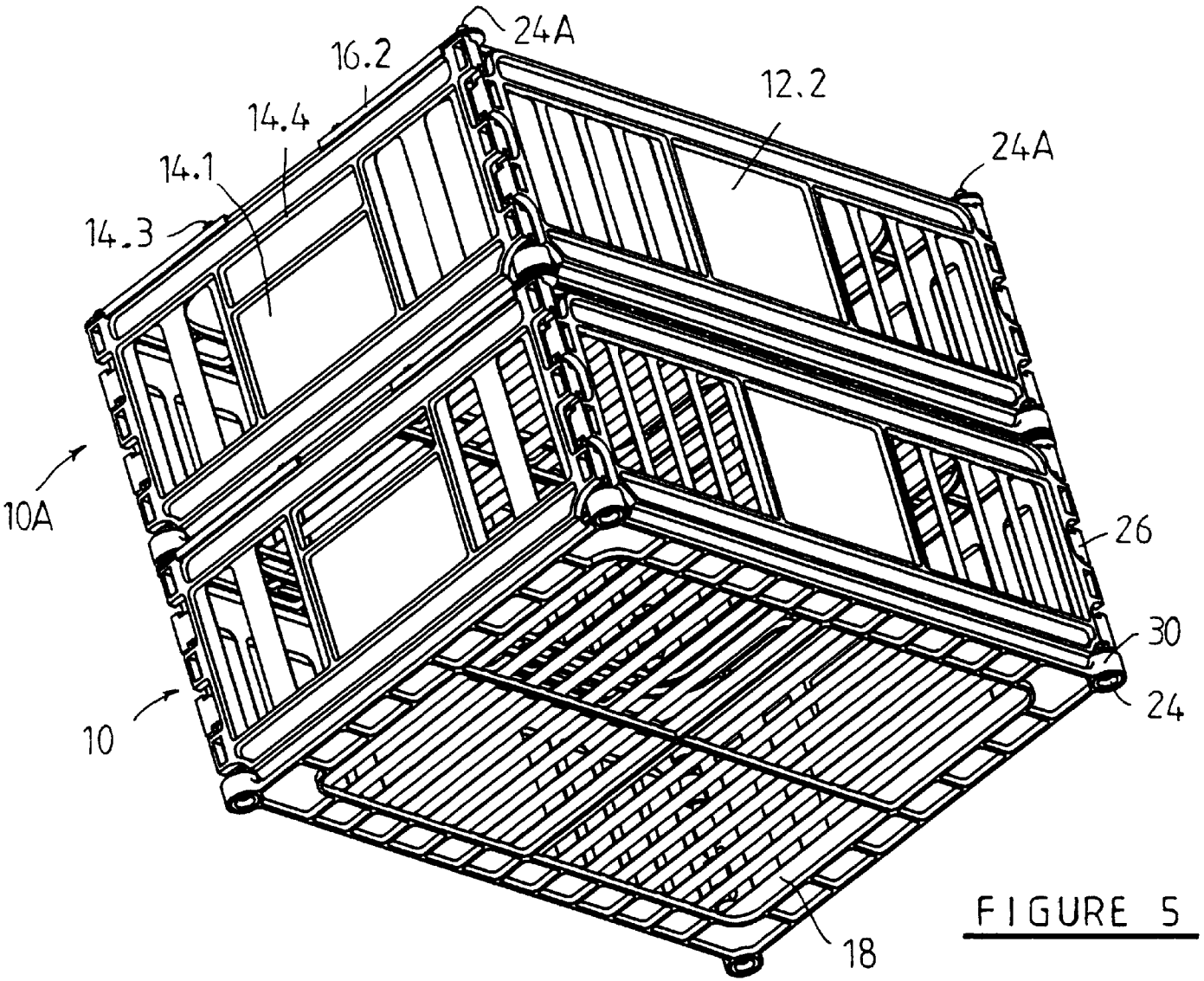
FIG. 5 is a perspective view from below of two of the containers of FIG. 1, in stacked relationship.

Referring to FIGS. 4 and 5, the container 10 further includes four load bearing shafts 24 for connecting the side and end walls 12 and 14 to each other and for supporting the weight of the load bearing shafts 24A of another superjacent like container 10A, when the containers 10 and 10A are stacked. The load bearing shaft 24 comprises an elongate metal pin having a head 24.1 at one end and a rounded opposite end 24.2. The head 24.1 defines a socket 24.3 which tapers conically inwardly for aligning the rounded end 24.2 of another shaft 24, when two containers 10 are being stacked.

Figure 6:
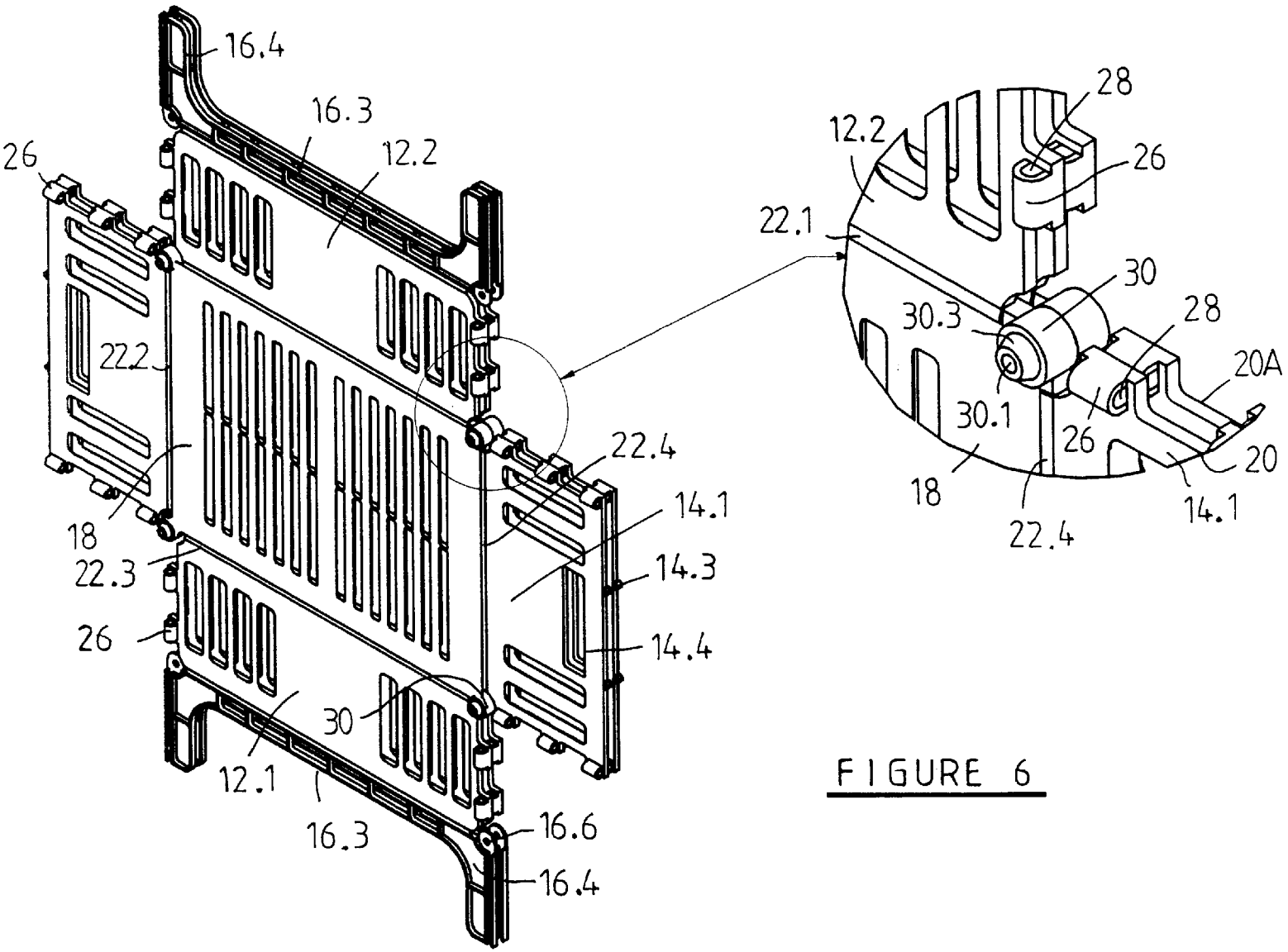
FIG. 6 is a perspective view from above of two of the blanks of FIG. 2 in stacked relationship.

Referring to detail A in FIG. 1, FIG. 4 and detail G in FIG. 6, opposite side meeting edges (generally designated by numeral 25) of each side and end wall 12 and 14 are each provided with connecting means which comprises a plurality of loop formations 26. The loop formations 26 are staggered and spaced so that the loop formations 26 of one wall intermeshes with the staggered loop formations 26 of another wall. Each loop formation 26 defines a longitudinally extending opening 28 for receiving one of the load bearing shafts 24. The arrangement is such that an upper end of the shaft 24 protrudes above the upper plane of the container 10.

Each corner of the floor panel 18 is provided with a foot piece 30 defining a bore 30.1. The bore 30.1 has first portion which is of substantially the same diameter as the elongate portion of the shaft 24; an enlarged second portion 30.2 (FIG. 4) for receiving the head 24.1 of the shaft 24; and a conical spigot formation 30.3, for aligning two blanks 20 and 20A which are being stacked. Referring to FIG. 6, a plurality of identical blanks 20 and 20A can thus be stacked flushly for the purposes of storage and transport, with the spigot formation 30.3 of a lower blank 20A being received in the enlarged bore 30.2 of an upper blank 20.

Each cover panel 16 comprises an elongate portion 16.3 which is hinged to one of the side walls 12, and two arm members 16.4 disposed towards opposite ends of the elongate member 16.4. Referring to detail E in FIG. 2, each elongate member 16.4 is provided with a female connecting formation 16.5 for releasably connecting in clip-on fashion to a complementary resiliently deformable male retaining formation 14.3 disposed on the upper edge of one of the end walls 14. Holes 16.6, through which the ends 24.2 of the shafts 24 can extend, are respectively provided in the corners of the cover panels 16. A groove formation 16.7 for receiving the upper edge of the end walls 14 is provided in the arm members 16.4.

The end walls 14 are each provided with a grip formation 14.4 and all the panels and walls of the container 10 are provided with apertures or parallel extending elongate slots, to further reduce the weight of,—and the amount of plastics material required to manufacture, the container 10.

When the container 10 is to be assembled, the walls 12 and 14 are simply pivoted towards each other and the loop formations 26 intermeshed to align the openings 28. The cover panels 16 closed and retained in the closed position by the retaining formations 14.3, and the shafts 24 pushed through the openings 28 of the loop formations 26 and the holes 16.6, until the heads 24.1 of the shafts 24 are respectively received in the enlarged bores 30.2. Fresh produce such as fruit and vegetable sis packed inside the container.

It will be appreciated that due to the fact that the load bearing shafts 24 support the weight of superjacent containers and not the containers themselves, the housing portion 11 of the container 10 may be manufactured from a relatively thin light plastics material, with the shafts 24 being suitably strong to support the required weight of the stacked containers 10.

It will further be appreciated that the container 10 can be assembled relatively easily by an unskilled worker. Furthermore, due to the unitary configuration of the blank 20, the container 10 is sufficiently strong to be manipulated when filled with produce, notwithstanding the relatively small amount of plastics material required for the manufacture of the container 10.

Referring to FIGS. 7 to 10 a stackable collapsible container according to a second embodiment of the invention, is generally designated by reference numeral 110.

The container 110 comprises a housing which is constituted by a first pair of opposed side walls 112.1 and 112.2; a second pair of opposed end walls 114.1 and 114.2; a separate removable annular cover member 116; and a separate removable floor panel 118.

Figure 10:
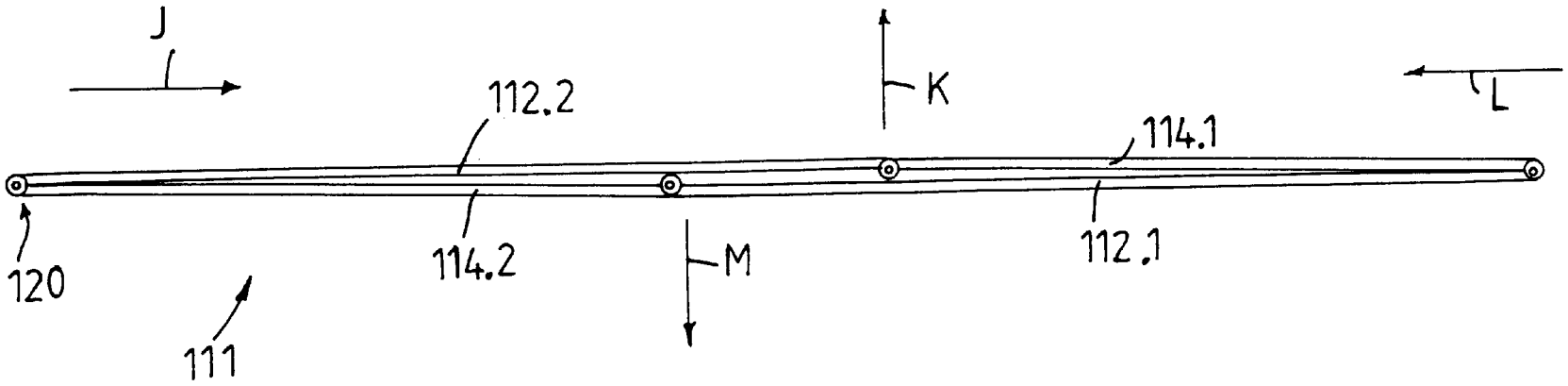
FIG. 10 is a plan view of a rectangular structure of the container of FIG. 7, in a collapsed condition.

The side end walls 112 and 114 are hinged together to form a rectangular structure 111 and each of the side and end walls 112 and 114 is provided with a hinge formation 120 at the side meeting edges of each wall, for connecting and hinging to one of the hinge formations 120 of one of the other walls. The arrangement is such that, when the cover member 116 and floor panel 118 are removed from the rectangular structure 111, the rectangular structure 111 is collapsible as shown in FIG. 10.

Figure 7:
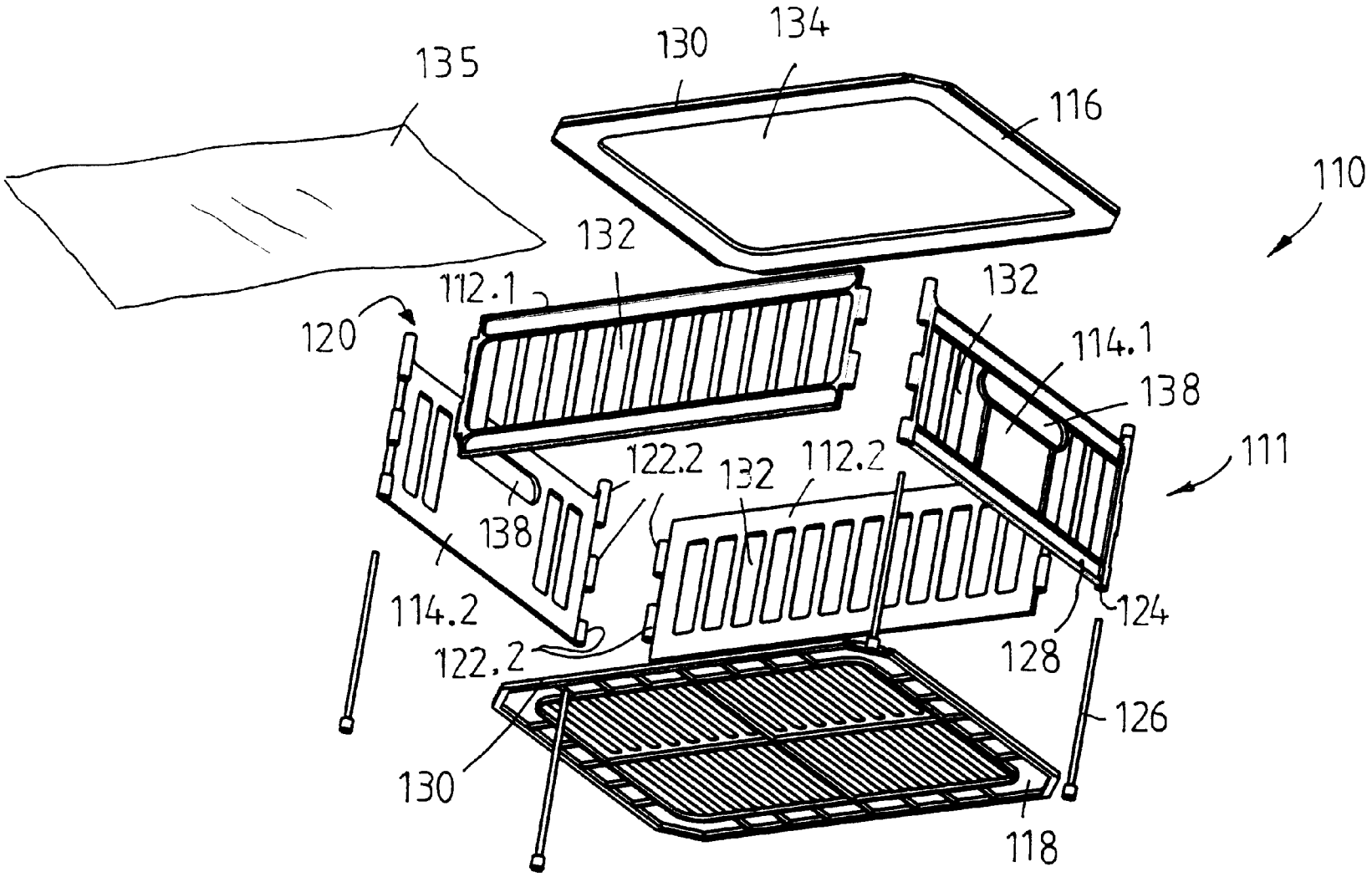
FIG. 7 is an exploded perspective view from below of a collapsible stackable container according to a second embodiment of the invention.
Figure 8:
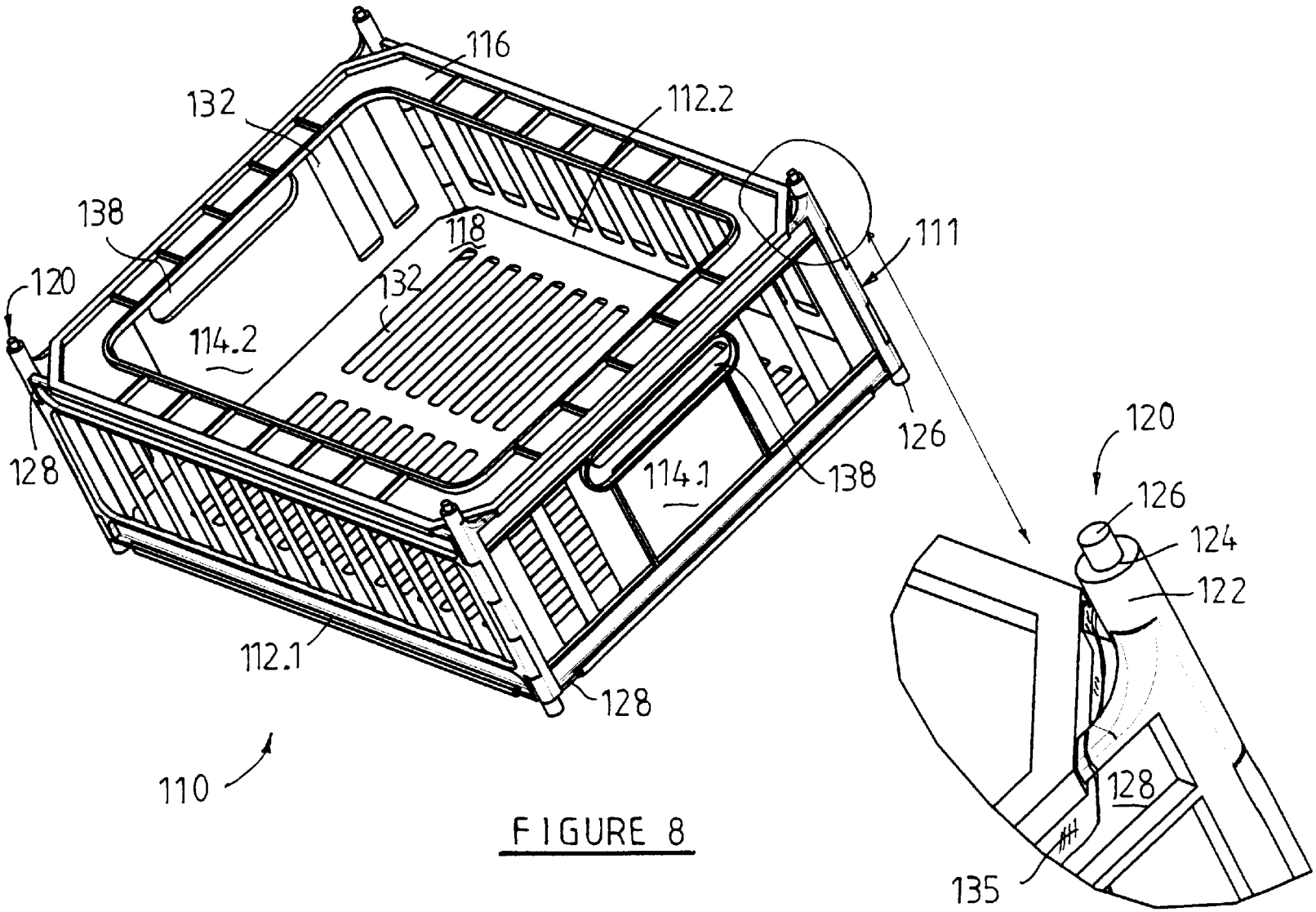
FIG. 8 is a perspective view from above of the container of FIG. 7, in assembled form.
Figure 9:
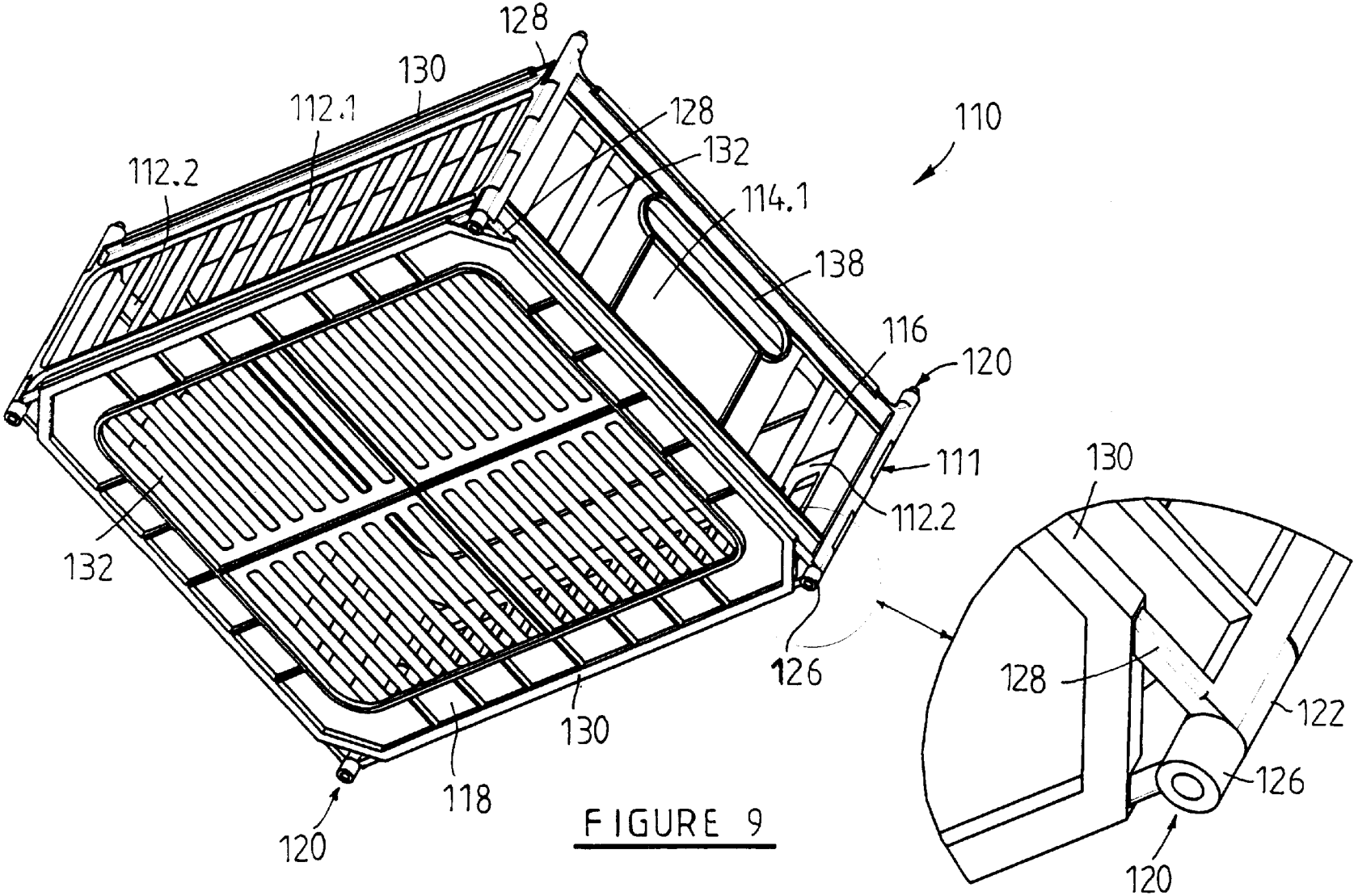
FIG. 9 is a perspective view from below of the container of FIG. 8.

Referring to details H and I in FIGS. 8 and 9, each hinge formation 120 comprises a plurality of tubular hinge members 122 which are staggered and spaced so that the hinge member 122 of one wall intermeshes with the staggered hinge member 122.2 of another wall. Each hinge member 122 defines a longitudinally extending bore 124 (FIG. 7) for receiving a load bearing shaft 126 for supporting the weight of one of the load bearing shafts of another superjacent like container, when the containers are stacked. The arrangement is such that an upper end of the shaft 126 protrudes from the hinge member 122 disposed towards an upper region of the container 110, to provide a spigot; and the other end of the shaft 126 defines a socket for receiving the spigot of another identical shaft 126. A hinge is thus constituted by a set of hinge members 122 and a shaft 126.

The walls 112 and 114 are each provided with a ridge formation 128 along an upper edge and along a lower edge of each wall. The cover member 116 and the floor panel 118 are each provided with channel formations 130 along their outer edges for engaging the ridge formations 128 in clip-on fashion.

The walls 112 and 114 and the floor panel 118 are provided with elongate parallel extending slots 132 to reduce the weight of the walls and the floor panel.

Referring to FIG. 7, the cover member 116 is annular and defines a central opening 134 and the container 110 is further provided with a flexible transparent 135 for closing the opening 134. In use, the web 135 is trapped between the upper ridge formations 128 of the walls 112 and 114 and the channel formations 130 of the cover member 116. The floor panel 118 may alternatively be identical to the cover member 116 and may be closable by a similar flexible web (not shown).

The container 110 may further be provided with a removable tray (not shown) having individual receptacles for receiving produce such as fruit or vegetables or other objects and which tray is supported on the floor panel 118. Each end wall 112 is provided with a grip formation 138 for handling of the container 110.

In use, the container 110 is assembled by aligning the bores 124 of the hinge members 122 of the end and side walls 112 and 114 with each other and pushing one of the shafts 126 through each of the bores 124. Diagonally disposed corners of the rectangular structure 111 are moved relative to each other to collapse the rectangular structure 111. The rectangular structure 111, the trays, and the cover member 116 and floor panel 118 of a plurality of identical containers 110 are stacked and transported in compact form to a producer. The producer erects the rectangular structure 111 by moving diagonally disposed corners relative to each other as indicated by arrow J to M in FIG. 10, to form a rectangle and by clipping the floor panel 118 onto the rectangular structure 111. A tray is supported on the floor panel 118 and the container 110 filled with produce. The web 135 is located over the produce and the cover member 116 clipped onto the rectangular structure 111 to trap the web 135. Various identical containers 110 are stacked and transported to users of the produce.

It will be appreciated that due to the fact that the load bearing shafts 124 and 126 referred to above support the weight of superjacent containers and not the containers themselves, the housing portion of the container may be manufactured from a relatively thin light plastics material, with the shafts being suitably strong to support the required weight of the stacked containers. It will be appreciated further that the container 110 may either be disposable or reusable and, should any component of the container 110 get damaged, it can be replaced relatively easily.

It will be appreciated even further that a large number of variations in detail are possible with a collapsible stackable container according to the invention without departing from the scope and/or spirit of the appended claims.

What is claimed is:

1. A stackable container suitable for transporting produce, comprising:

a housing constituted by a first pair of opposed side walls, a second pair of opposed end walls, a cover member, and a floor panel, the housing being molded from a plastics material in the form of a unitary stackable blank, with the side and end walls being hinged to the floor panel and the cover member being hinged to one of the walls;

a plurality of separate elongate load bearing shafts connected to the housing and adapted to bear the weight of a superjacent container when two like containers are stacked;

the walls each having two opposite side meeting edges, with one of the side meeting edges of one wall being connected to one of the side meeting edges of an adjacent wall by one of said load bearing shafts;

the side meeting edges of the walls being provided with connecting means, with each connecting means comprising a plurality of staggered connecting formations for intermeshing with the staggered connecting formations of one of the other walls and wherein each connecting formation defines an opening which is aligned with the openings of other connecting formations, for respectively receiving the load bearing shafts; and each load bearing shaft comprising a head at one end defining a socket for receiving an opposite end of a load bearing shaft of a subjacent like container.

2. A stackable container according to claim 1 wherein the load bearing shafts are positioned with their heads and sockets extending to a point which is below that of the floor panel.

3. A stackable container according to claim 1 wherein the load bearing shafts are metal rods.

* * * * *